United States Patent [19]

Blackston et al.

[11] Patent Number: 4,534,131

[45] Date of Patent: Aug. 13, 1985

[54] REVOLVING DOOR SECURITY SYSTEM

[75] Inventors: Michael D. Blackston, Brooklyn Park; Gary Reinecke, Moundsview, both of Minn.

[73] Assignee: Heise Manufacturing, Minneapolis, Minn.

[21] Appl. No.: 546,827

[22] Filed: Oct. 31, 1983

[51] Int. Cl.[3] ..... E05D 15/02

[52] U.S. Cl. ..... 49/42; 109/8

[58] Field of Search ..... 49/42, 43, 44, 263, 49/264; 109/3, 8

[56] References Cited

U.S. PATENT DOCUMENTS

| | | |
|---|---|---|
| 2,341,545 | 2/1944 | Hagenbook . |
| 2,954,971 | 10/1960 | Simpson . |
| 3,020,038 | 2/1962 | Simpson . |
| 3,285,209 | 11/1966 | Pace . |
| 3,307,660 | 3/1967 | Sheckells . |
| 3,308,912 | 3/1967 | Sheckells . |
| 3,349,876 | 10/1967 | Sheckells . |
| 3,403,571 | 10/1968 | Sheckells . |
| 3,473,261 | 10/1969 | Sheckells . |
| 3,497,997 | 3/1970 | Sheckells . |
| 3,526,820 | 9/1970 | Sheckells . |
| 3,717,954 | 2/1973 | Sheckells . |
| 3,762,098 | 10/1973 | Sheckells . |
| 3,766,686 | 10/1973 | Sheckells . |
| 3,793,773 | 2/1974 | Sheckells . |
| 3,886,684 | 6/1975 | Sheckells . |
| 3,968,595 | 7/1976 | Sheckells . |
| 4,063,519 | 12/1977 | Pretini . |
| 4,154,023 | 5/1979 | Carroll . |
| 4,295,297 | 10/1981 | Carroll et al. . |
| 4,475,308 | 10/1984 | Heise et al. ..... 49/42 |

FOREIGN PATENT DOCUMENTS

| | | |
|---|---|---|
| 2803765 | 8/1979 | Fed. Rep. of Germany . |
| 2025513 | 1/1980 | United Kingdom ..... 49/42 |

*Primary Examiner*—Kenneth Downey

*Attorney, Agent, or Firm*—Merchant, Gould, Smith, Edell, Welter & Schmidt

[57] ABSTRACT

A revolving door system has a central axis defining a center shaft and three wing hangers rigidly joined and extending in a equidistant spaced apart relationship about the center shaft's upper portion.

A pair of facing substantially semicircular walls, spaced apart to define regions of ingress and egress, partially surrounds the wings and shaft on opposite sides.

The system allows free passage of persons in an authorized direction while preventing, and driving out, intruders attempting to pass in an unauthorized direction. If an intruder enters the system in an unauthorized direction, the door stops before the intruder has free passage to the other side, reverses direction and forces the intruder back toward the entrance. In one configuration, the door then rotates in its forward direction to permit the authorized passenger to escape the system, but not far enough to allow the intruder to pass. In another configuration, the reversal of the door allows the passenger to escape from the side in which it entered. The system then recycles alternately reverse and forward again until the intruder is convinced to leave the system or the authorized passenger has escaped, whereupon the system returns to its normal stop position and the intruder is prevented from passing.

12 Claims, 14 Drawing Figures

REVOLVING DOOR SECURITY SYSTEM

TECHNICAL FIELD

This invention related to a revolving door security system used to permit unimpeded access into an area in one direction while providing complete security against unauthorized access in the opposite direction.

Revolving doors have long been used to secure areas against unauthorized passage. These doors have the advantage of high through-put with a minimum operating expense. A revolving door system used for security is described in U.S. patent application No. 353,165, filed Mar. 1, 1982, entitled Revolving Door System. In that application, sensors are provided to detect the presence of an object attempting to pass through the door in an unauthorized direction. The door is caused to reverse direction and back up. The intruder will then appreciate that he cannot pass through and will vacate the area, whereupon the door will resume its normal forward rotation. While this system is extremely effective in deterring intruders, it may also trap others within the revolving door system during the period in which the intruder is being backed up of the door. Thus a persistent intruder could theoretically trap others in the system indefinitely.

The present invention overcomes this problem while maintaining all of the benefits of the prior system. The advantages are accomplished without trapping persons passing in either direction.

SUMMARY OF THE INVENTION

The present invention is directed to a method of preventing the passage of objection in a unauthorized direction through a revolving door including the steps of detecting the presence of the unauthorized object entering in an unauthorized direction, stopping the normal rotation of the door before the object has free passage into the secured area, alternately rotating the door in a reverse direction to force the object backwards and out of the system, and then rotating the door in the forward direction. The authorized passenger is allowed to escape the system in one or the other direction while the intruder is prevented from passing indefinitely.

According to another aspect of the invention, the present invention is directed to an apparatus for preventing unauthorized passage of an intruder in one direction through a revolving door, the apparatus including a powered revolving door system capable of reverse operation, having a rotatable center shaft, a plurality of wings extending circumferentially from the shaft, a pair of upright opposing arcuate panels spaced apart to define partially enclosed sectors bounded by pairs of wings and defining a pair of openings, to the system, the invention including alternating means responsive to a detector for sensing the presence of an intruder in one of the sectors rotating the shaft in one direction for a predetermined angular rotation and then reversing the shaft rotation to a second predetermined angular rotation until the detector no longer senses the presence of the intruding object.

According to a further aspect of the invention, the door is rotated in a first direction sufficiently to allow any authorized passengers trapped in the door during the period when the intruder attempts to pass, to escape through the system in their intended direction and wherein the door returns to its original position thereafter, preventing the passage of the intruder.

BRIEF DESCRIPTION OF THE DRAWINGS

A better understanding of the invention may be had by reference to the specification taken in connection with the following drawings in which.

DETAILED DESCRIPTION

Figure 1:
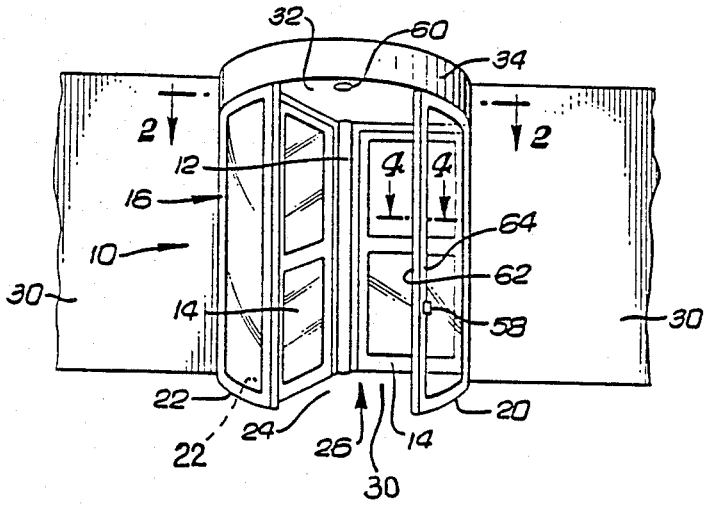
FIG. 1 is a perspective view of a revolving door system.

Although the present invention can be applied to most powered reversible revolving doors, an example of such structure is detailed below. With particular reference to FIG. 1, a revolving door system 10 generally comprises an upright vertical center shaft 12 defining an upright axis and three spaced apart upright panels or wings 14 disposed circumferentially equiangularly about and rotatable about the axis, with the shaft 12. A drum 16 is provided for covering the wings 12. The drum 16 includes facing substantially semicircular or curved panels 20, 22 partially enclosing the wings 14 and the shaft 12 and defining a partially enclosed generally circular region 24. The panels 20, 22 are spaced apart to define opposing entry 26 and exit (unmarked) openings. Extending outwardly on opposite sides of the curved panels 20, 22 are front walls 30 for preventing access. The three wings 14 of the revolving door 10 divide the generally circular region 24 between the curved panels 20, 22 into three moveable cylindrical segments having a cross section of constant equal area. The shaft 12 and thus the wings 14, though rotatable define into a sequence-point position when any two of the wings 14 enclose a curved panel 20, 22. A mat switch 29 is disposed on the floor within the confines of the sequence-point position bounded by the panel 22 and a mat switch 31 is disposed on the floor within the confines of the quarter-point position bounded by the panel 20. The mat switch 29 senses the presence of an individual seeking entry from the exit opening 28. So that the door may be used in a reverse mode, the mat switch 31 also senses the presence of an individual seeking improper access, when the entry 26 and exit 28 are reversed. As a result of the wing spacing an individual entering one segment is separated from any individual in either adjacent second segment.

Figure 2:
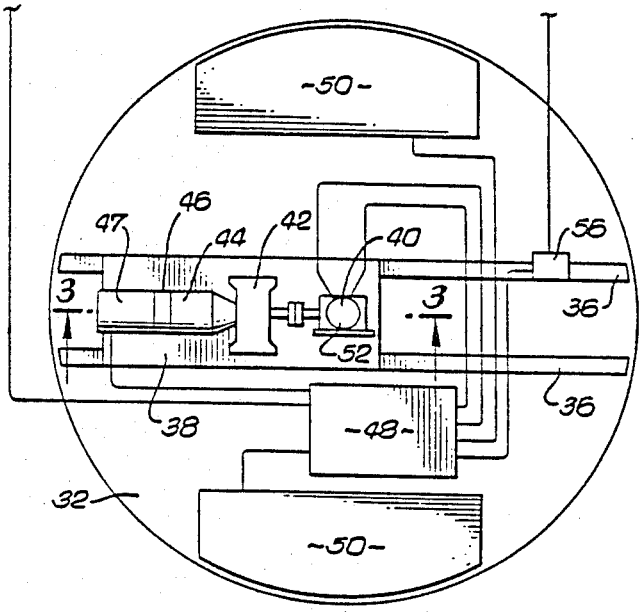
FIG. 2 is a cross-sectional plan view taken along lines 2—2 FIG. 1.
Figure 3:
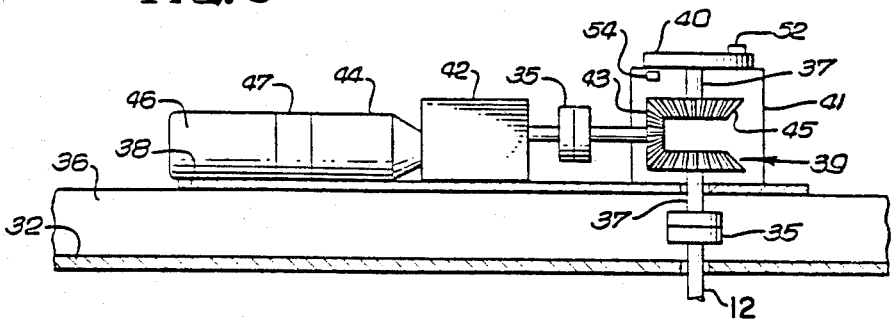
FIG. 3 is a diagrammatic cross-sectional elevational view taken along lines 3—3 of FIG. 1.

The drum 16 comprising a ceiling 32 and a cylindrical vertical facia 34 extending upward from the ceiling 32. As best viewed in FIG. 2, a pair of parallel spaced apart longitudinal rails 36 extend across the ceiling 32 about the diameter of the ceiling 32. A rectangular plate 38 disposed parallel to the ceiling 32 is joined to the rails 36. As best viewed in FIG. 3, the shaft 12 extends through the ceiling 32. A coaxial coupling 35 couples a rod 37 to the shaft 12. The rod 37 is coupled to a right angle gear assembly 39. A different rod 37 extends upward from an upper bevel gear 45 of the right angle gear assembly 39, and terminates in a circular plate 40 above a support plate 41. The circular plate 40 is rotatable with the rod 37, and in this example, at the same speed as the shaft 12. The right angled gear assembly 39 includes a central bevel gear 43 which is coupled by another coaxial coupler 35 to a gearing assembly 42, which in turn is coupled to a motor reducer 44. An electromechanical brake assembly 47 couples the motor reducer 44 to a motor 46. The gearing provided by the right angle gear assembly 39, the gear box 42 and the motor reducer 47 typically provides a motor to center shaft gear ratio on the order of 150:1. The motor 46 is typically a $\frac{1}{4}$ horsepower motor with a permanent magnet field, though the size depends upon the particular installation. The motor 46 operates in connection with the application of a resistive load to regeneratively brake the motor 46 in most situations. The combination of the high gear ratio along with regenerative or dynamic braking provides sufficient resistance to movement of the wings 14 for all practical purposes to prevent manual rotation when regeneratively braked. (For security purposes, the door may not be manually rotated.) This results in an economical controller and braking arrangement. However, in installations requiring exceptionally high security, an electromagnetic brake, such as brake 47, may also be used to assure that the door is prevented from movement when actuated.

A controller 48 located above the ceiling 32 is electrically coupled to and controls the motor 46, and a pair of light boxes 50 for illuminating the door or lighting signs. Three magnets 52 are disposed on the circular plate 40. A pair of proximity switches 54 are coupled adjacent the magnet 52 on the support plate 41 to sense the position of the shaft 12. The first proximity switch 54 is used prior to the end of a cycle to direct the shaft 12 to slow down. The other proximity switch 54 defines the end of a cycle, causing the motor 46 to brake. Position sensing is independent of the starting location of the shaft 12 and the magnets are positioned so that rotation of the wings will always terminate in a quarter point position. The controller 48 receives power from an electric box 56 on one of the rails 36.

A handicap pushbutton switch 58 is disposed adjacent the opening 26 and exit 28. The switch 58 is coupled to the controller to cause the running speed of the motor 46 to be reduced when actuated.

A motion detector 60 such as a microwave detector is disposed on the facia 34 adjacent the entry 26 to sense the presence of a person in the region of the entry 26. An example of a suitable detector is that of Model D7 provided by Microwave Sensors of Ann Arbor, Mich. Typically the detector defines a region whereby the movement of an object within the general confines of the defined region alters a very low power broad microwave beam, which senses the movement and actuates a relay, although card readers, etc. can also be used.

Figure 4:
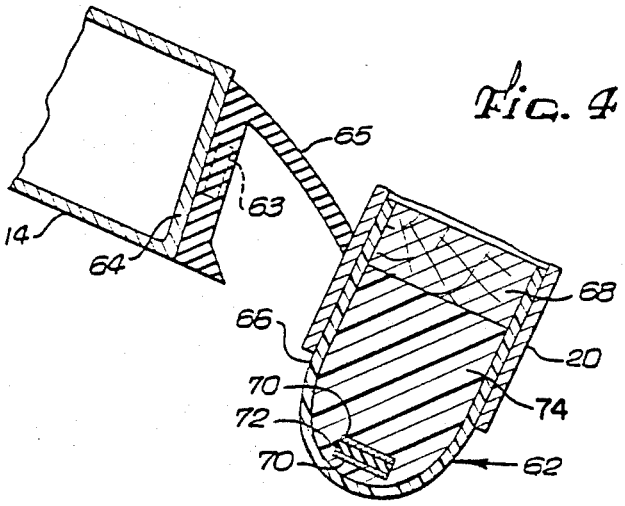
FIG. 4 is a detailed cross-sectional view taken along lines 4—4 of FIG. 1.

With particular reference to FIGS. 1 and 4, a drum edge switch 62 is disposed along the vertical edges 64 of the curved panels 20, 22. The drum edge switches 62 sense physical interference between the drum edge 64 and the wings 14, such as a human limb or object. The drum edge switches 62 comprise a curved rubber extrusion 66 vertically disposed along the panel edge and joined to a wooden support block 68 adjacent the vertical edge of the curved panels 20, 22. A pair of narrow vertically disposed longitudinal metal plates 70 separated by an apertured thin (typically less than 2 mm.) rubber strip 72 are glued with a silicone compound to the inner surface of the rubber extrusion 66. The interior space of the rubber extrusion is filled with foam rubber 74 to give it form. Similar edge switches 62 may be provided for vertical edges of the wings 14 in some examples of the invention. Similarly, door edge switches 63 may be disposed along edges 64 of the wings 14 where a weatherstripping 65 is shown in FIG. 4.

The operation of one preferred embodiment of the present invention can be most clearly understood by turning to FIGS. 6–13 where the action of the door is clearly described by means of diagrams.

Figure 6:
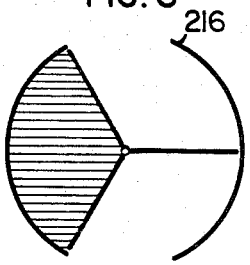
FIG. 6–13 are diagrammatic views of the operation of the preferred embodiment.

FIG. 6 indicates the normal starting point for the door, which is stopped when there is no traffic attempting to pass through.

Figure 7:
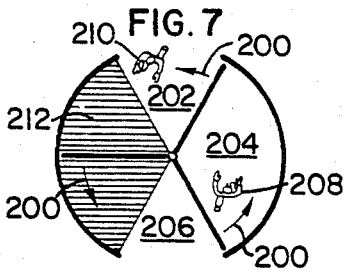
Figure 8:
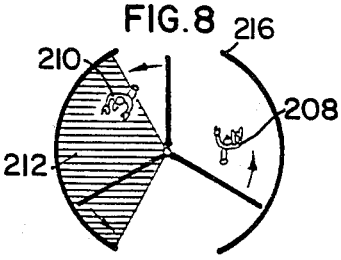
Figure 9:
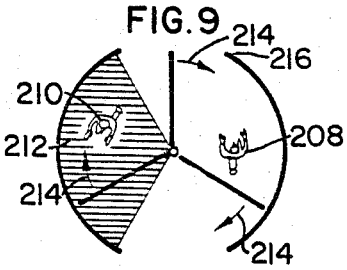
Figure 10:
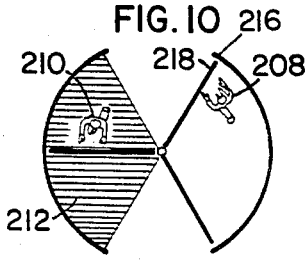
Figure 11:
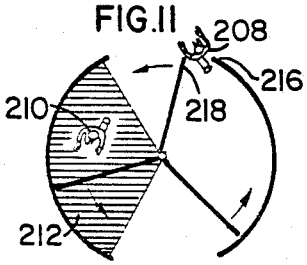
Figure 12:
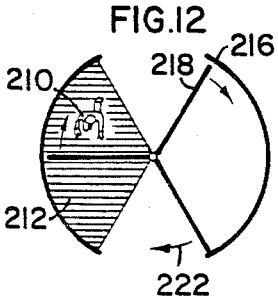

In FIG. 7, the normal rotation of the door is, in this case, counterclockwise as indicated by arrows 200. In this configuration, the passageway is divided into three sectors, namely, 202, 204 and 206 and passages authorized in the direction shown by the arrows 200 and the schematic representation of a person 208 shown in sector 204. The representation of a person 210 shown entering sector 202 indicates the attempted passage of an intruder into the system in an unauthorized direction. FIG. 8 shows the intruder entering the shaded area 212 which is under surveillance by means of a floor mat switch or other sensor, such as microwave, which detects its presence. Once the intruder enters the shaded zone, the door is caused to reverse direction as indicated in FIG. 9 by arrows 214. The intruder is thereby forced to back up toward the entrance from which he came. This is indicated in FIG. 9. Unfortunately, the authorized person 208 would also become trapped as the result of the system's attempt to expel the intruder as shown in FIG. 10. To free the authorized passenger 208, the system will return to its original direction of rotation and continue to rotate approximately 15 degrees (in the preferred embodiment) beyond the point where curved portion 216 and wing 218 were in contact, as shown in FIG. 11. This will permit the escape of the authorized passenger 208 without allowing the intruder to pass through the system. If the intruder 210 leaves the surveillance area 212, the wing 218 will continue in a counter-clockwise direction to a stop position as indicated in FIG. 11. If the intruder 210 does not leave the surveillance area 212, the doors will reverse direction again until they reach the position shown in FIG. 12 to force the intruder backward and toward the entrance from which he came. The system will then return to its original direction of rotation and continue to rotate approximately fifteen degrees beyond the point where curved portion 216 and wing 218 were in contact, as shown in FIG. 11. If the intruder persists in remaining in the surveillance area 212, the door will continue this "ratchet" action indefinitely as explained above (FIGS. 10–12).

Figure 13:
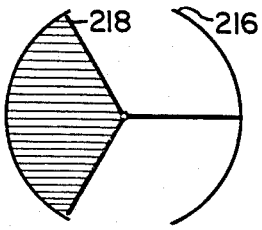

When the intruder leaves the surveillance area 212, the door will rotate forward until it reaches the stop position as shown in FIG. 13. The system is now ready for use again.

It will be appreciated from the above and the drawings that the authorized passenger will escape out of the system in one of two directions depending upon the position of the door when the intruder entered. The example shown in the Figures allows a forward escape, but if the intruder enters before 60 degrees of forward rotation, the escape will be in the reverse direction. When the door is operated in the "A" direction (FIG.

5A) as explained infra, the same circumstance will arise although at a different offset 120 degrees to 180 degrees.

The requirements of the system are first, that the door be capable of electrically powered reverse and forward rotation and that it cannot be caused to manually rotate by efforts of an intruder.

Although fifteen degrees is the preferred angular rotation for the "ratchet" action, the actual limitation is 60 degrees for a three-door system or 360 degrees divided by two times the number of doors.

In the preferred embodiment, the system is symmetrical so that the operator can choose and easily switch the permitted direction of passage.

The preferred embodiment of the system involves a door with 3 winged panels. However, it is appreciated that other configurations are equally possible. In general, the critical feature is that reversing or ratchet action of the door may not be so great as to allow passage of the intruder while affording appropriate passage for the authorized user. Specifically, the reverse rotation of the door (ratchet action) can be one-half of the rotational arc length of the door which is calculated as 360 degrees divided by the number of wings in the system. Thus, in a three-door system, the arc length is 120 degrees and the maximum reversal can be 60 degrees.

Figure 5:
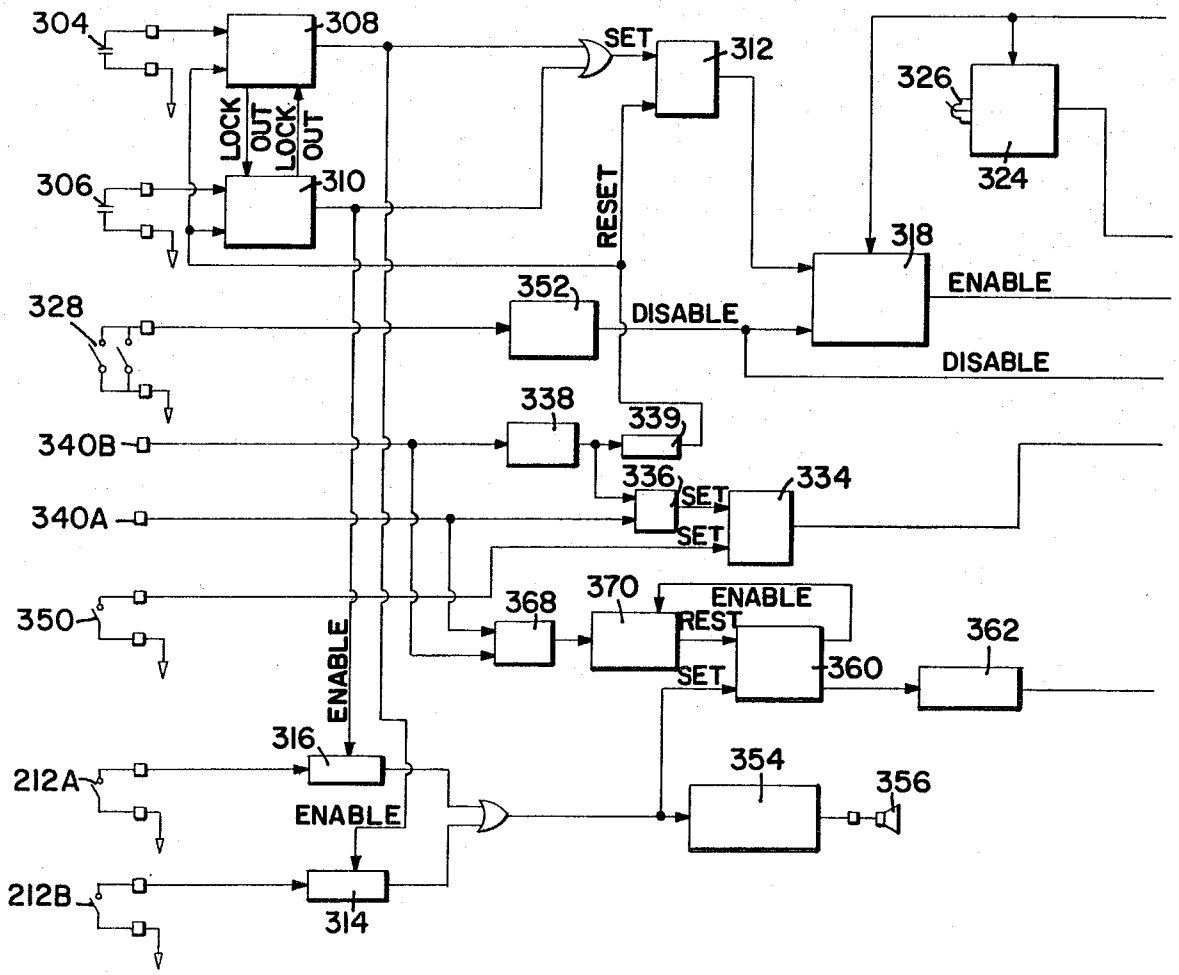
FIG. 5 and 5A are block diagrams of the circuitry of the preferred embodiment.
Figure 5A:
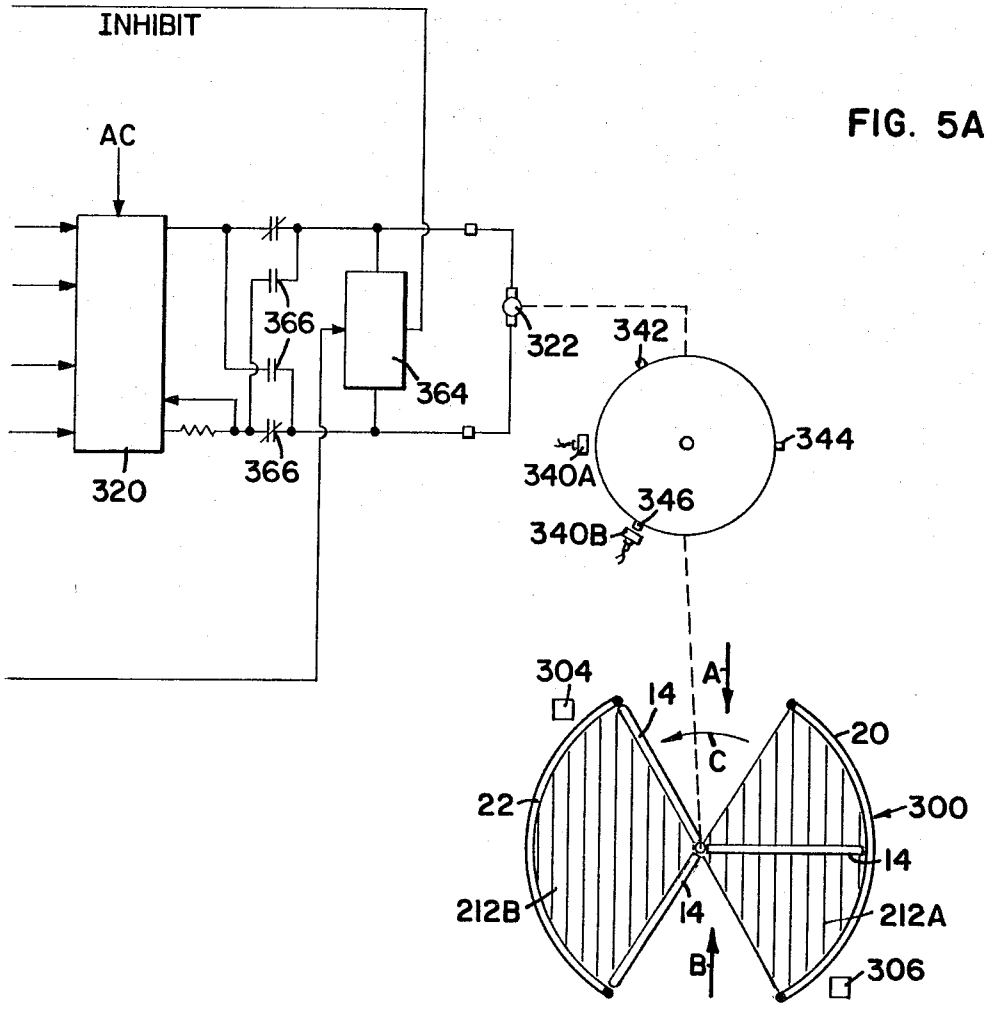

FIGS. 5 and 5A of the drawings described diagrammatically the operation of the circuitry of the preferred embodiment. It will be appreciated that the components here shown in the diagram are standard devices and that a person skilled in the art can easily prepare an appropriate circuit from this information.

FIGS. 5 and 5A describe circuitry which applies to the above-description but also includes additional enhancements which may be considered an alternative preferred embodiment. In this embodiment, the security door can be operated in either direction although the operation in each direction is somewhat different.

For simplicity, we have labeled the direction of flow in FIG. 5A of the revolving door 300 as "A" and "B", The door rotates in this configuration in the counter clockwise direction as indicated by arrow C.

To activate the system, from either side, in this embodiment, a programed card is inserted within card reader 304 or 306 as appropriate. These card readers are indicated as switches on the circuit diagram shown in FIG. 5. The input from the card readers is latched by latches 308 or 310 and their outputs are fed into a run/-stop latch 312. The latch enables drive logic 318 which likewise operates the PWM (pulse width modulation) door motor speed control 320 (although other types of speed control may be employed). The signal from the drive logic 318 would enable the control 320 and the door would be operated by means of motor 322.

The actual location of the wings 14 with respect to the curved portion 20, 22 is not actually known except when proximity switch sensors 340A and 340B detect the passing of permanent magnets 342, 344 or 346 which are located on a cam plate preferably above the doors with the same central axis as used by the doors. The location of the magnets 342–346 is colinearly aligned with the doors. The sensor 340B is located so as to cause the rotation of the door to stop when one of the magnets is adjacent the sensor indicating that the door is the stop position shown in FIGS. 5A and 13. Sensor 340A is 60 degrees back (clockwise) of 340B. The location of 340A is of course dependent and the number of doors based on the formula above.

After the door has been started as indicated above, the first sensor 340A initiates a time deceleration of the drive motor 322 to run at half speed. This is accomplished by a pulsing of 340A which in turn initiates time delay 336 which in turn operates the one-half speed command circuit 334, selecting a lower speed for the PWM control 320. The purpose of the speed reduction is to prepare for the ultimate stop of the door which will occur quite suddenly in a pulse width modulation speed control and the passenger may accidently walk directly into the glass door not realizing it had stopped.

After the time delay has passed and the speed has been reduced to one-half, the door will be regeneratively braked to a stop when a particular door edge is sensed by 340B, which pulses counter 338 which resets enabling stop circuit 339 which resets run/stop latch 312, disabling logic 318. This causes control 320 to stop powering motor 322. This will have occurred after 120 degrees rotation and the passenger will have been permitted enough rotation of the door to pass through the system. The door is also now in the proper position for the next passenger.

The handicap switch 350 is provided to switch the rotation speed to one-half.

An emergency stop switch input 328 is provided which triggers an emergency stop restart timer circuit 352 which disables drive logic 318 and speed control 320. This switch 328 would be used in the event that something became caught between the door edge and door post. After a period of time, if the object is removed from the switch, the door is reabled.

To detect the presence of unauthorized intruders, mats 212A and 212B are provided. The "A" mat used to detect presence of an intruder when the door is operating in the "A" direction and the "B" mat when the door is operating in the "B" direction as shown in FIG. 5A.

When a person steps on the 212B mat, when the system is activated in the "B" direction, logic control circuit 314 which has been enabled by latch 308 sends an alarm condition to the alarm driver 354 which in turn sounds a siren 356.

Simultaneously, the reverse direction latch 360 is set by the alarm condition and reverse direction control logic 362 causes the zero speed sensor and reversing relay control 364 to operate reversing relay 366, but only after deceleration to zero speed. Actually, upon receiving a "reverse command", the zero speed sensor 364 initiates a powered deceleration of the drive motor 322 by the PWM motor speed control 320. Only when the drive motor speed is detected to be zero, do the relays 366 reverse and the direction of door rotation is changed. If, however, one of the door edge magnets 342–346 is sensed by proximity switches 340A or 340B, the door will be decelerated to zero speed by quick regenerative braking and the relay 366 will be reversed. After a short delay, the control will now accelerate the door in the reverse direction to one-half speed. The lower speed is used so that the passenger will not be startled by the reversal. The door will continue to run in the reverse direction, pushing the intruder out the way he came in, until a door edge magnet 342–346 is detected by switch 340A, in this case. At this point, the door stops, reverses direction and accelerates in the forward direction at half speed. If the intruder does not get off the mat, the control will detect an alarm condition again, and the door will stop after it has rotated about fifteen degrees from the point at which sensor 340A was triggered. This fifteen degree rotation is dependent primarily on the reaction time of the circuitry and the nature of switch 340A. It can be adjusted by use of time delay sensors for example, so long as the rotation remains within the parameters mentioned above. It is only significant that the rotation not be so far as to allow the intruder to escape through the system. After the door is rotated fifteen degrees, it will stop and reverse back to the point at which sensor 340A is triggered again. The system will continue to "ratchet" back and forth until the intruder leaves the mat 212B. The door then proceeds in a forward direction at half speed until the 340B sensor is triggered. The door then will be regeneratively braked to zero speed.

Speed control is set by the run speed circuit 324 and adjusted by potentiometer 326. The drive logic 318 is prevented from being reactivated by card readers 304–306 due to an inhibit signal from zero speed sensor 364 which is present whenever an alarm condition (354) is present.

When the system is operated in the "A" direction card reader 304 must be activated and the operation is very similar to the above explanation except that the position of sensors 340A and 340B could require a slightly different interpretation of signals to accomplish the same result. When the door is therefore started by card reader 304, the delay timer 336 waits for one pulse of the door edge counter 338 which comes from sensor 340B and then looks for the next pulse from sensor 340A before initiating a time deceleration of the drive motor 322. Thus, two pulses are actually required to initiate deceleration. This is because the door actually rotates farther in this configuration than it did in the previous configuration. Whenever an alarm condition exists, i.e. an intruder steps on mat 212A, the first proximity switch encountered when the door is reversing (340A or 340B) becomes the reverse limit sensor.

The door is never allowed to reverse more than sixty degrees from the point at which it stopped when the alarm condition was received. This is because reset detector 368 has an input from sensors 340A and 340B and a pulse from either one indicates the limit point for reverse rotation of the door. This can actually happen with rotation in either the "A" or "B" directions. For example, in the "B" direction, if the intruder steps into the surveillance area before the door had completed its first 60 degrees of rotation, the reverse limit point would be signalled by sensor 340B, not 340A, as would be the case shown in FIGS. 6–13. In FIG. 7, the door has already rotated 60 degrees from the start position in FIG. 6.

Numerous characteristics and advantages of the invention have been set forth in the foregoing description, together with details of structure and function of the invention, and the novel features thereof are pointed out in the appended claims. The disclosure, however, is illustrative only, and changes may be made in detail, especially in matters of shape, size, and arrangement of parts, within the principal of the invention to the full extent of the broad general meaning of the terms in which the appended claims are expressed.

I claim:

1. In a powered reversible revolving door system having curved sidewalls and a door defined by a plurality of wings extending radially from a central axis, the wings defining a plurality of sectors, a method of preventing the unauthorized passage of an intruder through the system in one direction into a secured area without trapping an authorized passenger present in the system attempting to pass through the system in the other direction, including the steps of:

detecting the presence of the intruder entering a door sector to pass through the door in an unauthorized direction, stopping the rotation of the door before the intruder has free passage into the secured area, means automatically and alternately rotating the door in a reverse direction to force the intruder backwards and then rotating the door in a forward direction, said rotations being sufficient to allow the escape of the authorized passenger out of the system while simultaneously preventing passage of the intruder through the door, and continuing alternate rotation until the intruder is no longer detected in the system.

2. A method according to claim 1 including the further step of returning the door to a predetermined position after the intruder is no longer detected and then stopping the door until reactivated by an authorized passenger.

3. A method according to claim 1 wherein said door rotates sufficiently in the reverse direction to back up the intruder and to allow escape of the passenger in the direction from which it entered.

4. A method according to claim 1 wherein said door rotates in a reverse direction at a slower speed than in the forward direction.

5. A method according to claim 1 wherein the maximum reverse rotation of the door is defined in degrees by 360 degrees divided by two times the number of wings.

6. In a security revolving door system for preventing passage of an intruder through the door from a first side to a second side in an unauthorized direction, the system including a plurality of wings extending radially from a central axis, a pair of upright opposing arcuate side panels spaced apart to define partially enclosed sectors bounded by pairs of wings and defining a pair of openings, power rotating means for rotating the door in a forward direction, detector means for sensing the presence of an intruder entering the partially enclosed sector from the first side, reversing means for rotating the wings about the axis in the reverse direction, the improvement comprising automatic alternating means responsive to said detector means for alternately reversing the rotation for a first pre-determined angular rotation and the rotating the wings about the axis forward for a second predetermined angular rotation until said detector means no longer detects the presence of an intruder.

7. A method according to claim 3 wherein said second predetermined rotation is less than the angular rotation which would allow free passage by the intruder through to the second side.

8. A method according to claim 4 wherein said second predetermined angular rotation is small enough to maintain the adjacent side panel in contact with the outer edge of the wing closest the second side and which is in the sector the intruder is located.

9. A system according to claim 3 wherein said alternating means rotates the wings about said axis in a forward direction through sufficient angular rotation to allow passage to the first side by an intruder who was confined within a sector when said reversing means was operated.

10. A system according to claim 6 wherein said door includes 3 equi-distantly spaced wings and sides panels having an arcuate dimension of 45 degrees and wherein said alternating means rotates not more than 60 degrees in either direction.

11. A system according to claim 6 wherein the authorized passenger may enter either opening and start rotation of the door and thereby automatically define the reverse direction as being the unauthorized direction.

12. A system according to claim 6 including a pair of sensors capable of detecting the passing of a wing, said sensors being spaced around a circumference defined by the curved panels and wherein the sensors are separated by an angular distance in degrees defined by:

360 degrees divided by twice the number of wings in the system, said sensors being used to detect the position of the wings and control their degree of rotation.

* * * * *